United States Patent [19]

Berchoux et al.

[11] 4,345,355

[45] Aug. 24, 1982

[54] PROCESS AND APPARATUS FOR CUTTING A TOW AND CONTINUOUSLY OPENING THE FIBERS OBTAINED

[75] Inventors: André Berchoux, Couzon au Mont D'Or; André Coquet, Lyons, both of France

[73] Assignee: Rhone-Poulenc-Textile, Paris, France

[21] Appl. No.: 143,484

[22] Filed: Apr. 24, 1980

[30] Foreign Application Priority Data

Apr. 25, 1979 [FR] France ..... 79 10974

[51] Int. Cl.[3] ..... D01G 1/04

[52] U.S. Cl. ..... 19/0.6; 83/431; 83/566; 83/913

[58] Field of Search ..... 19/0.56, 0.58, 0.6, 19/0.62, 0.64, 0.46; 83/18, 100, 9.3, 431, 566

[56] References Cited

U.S. PATENT DOCUMENTS

| | | | |
|---|---|---|---|
| 3,503,100 | 3/1970 | Glynn et al. | 19/0.46 |
| 3,557,648 | 1/1971 | Coffin | 83/18 |
| 3,930,285 | 1/1976 | Wornall | 19/0.56 |
| 3,948,127 | 4/1976 | Vehling | 83/100 |
| 4,006,277 | 2/1977 | Laird | 19/0.6 |
| 4,014,648 | 3/1977 | Walsh et al. | 19/0.56 X |

FOREIGN PATENT DOCUMENTS

| | | |
|---|---|---|
| 1552889 | 12/1968 | France . |
| 2030230 | 3/1971 | France . |
| 2242491 | 6/1977 | France . |

*Primary Examiner*—Louis Rimrodt

*Attorney, Agent, or Firm*—Sherman & Shalloway

[57] ABSTRACT

Process and apparatus for continuously cutting a tow of continuous filaments and opening the resulting fibers are described. Immediately after the tow is cut, while the fibers are still in an orderly array, they are transported to an opening device, especially garnett wires, where the fibers are opened without damage.

The apparatus modifies existing tow cutting devices of the type including crown-arranged and radially oriented knives, means for winding the tow around the knife edges and means for pressing the tow against the knife edges by providing an annular fiber collector at the rear of the ring of knives for collecting the fibers while they are still oriented in the same direction and feeding the orderly array of fibers to at least one garnett wire carried on at least one rotatable cylinder located at the outlet of the fiber collector.

16 Claims, 6 Drawing Figures

PROCESS AND APPARATUS FOR CUTTING A TOW AND CONTINUOUSLY OPENING THE FIBERS OBTAINED

The present invention relates to a process and apparatus for cutting a tow and continuously opening the fibers obtained.

It is known to obtain artificial and synthetic fibers by cutting a tow of continuous filaments. After cutting, the fibers are generally not very well separated; the flock frequently contains bundles of fibers. Whatever is subsequent use may be, such as the manufacture of spun yarns, use in napping, or the like, it is sometimes necessary to open this flock.

It is known that it is possible to open the flock of fibers by the action of one or more garnett wires which are most frequently carried by rotating cylinders. However, in the flock, the fibers are oriented in a disordered manner. Furthermore, during the opening operation, the fibers can be damaged and broken by the action of the teeth, if they are presented in a random direction relative to the teeth. Moreover, the cut fibers are generally collected directly, compressed into bales and delivered in this form to the converter, and this further increases the formation of bundles.

The present invention relates to a process for opening the fibers obtained by cutting a tow of continuous filaments of artificial or synthetic textile material.

In the process of this invention, the tow, arriving continuously, is wound in an annular space between the edges of a series of cutting edges, e.g. knives, arranged in a ring, and a pressure means, so as to form at least one turn, the tow being cut by pressing the filaments against the cutting edges, the fibers are collected immediately downstream of the cutting edges while they are still presented in an ordered manner, and the fibers are transferred, still in an ordered manner, to an opening device.

The opening device which is advantageously used comprises, in a known manner, one or more garnett wires. The fibers presented to the opening device in an ordered manner are subjected to the action of the teeth of the garnett wires. This produces a very open flock, which is free of bundles, without damaging the fibers. Preferably, the fibers originating from the cutting of the tow are presented in a direction which is approximately parallel to the relative movement of the teeth intended for opening them. However, it is possible for the direction of movement of the teeth to form an angle which can range up to 90°. Attacking the fibers by the teeth at different angles makes it possible to adapt the process to various running conditions, to tows of varied characteristics and to the desired opening effect.

The present invention also relates to apparatus for carrying out the process.

The apparatus for cutting a tow of filaments and continuously opening the fibers obtained according to the invention, comprises a series of knives which are arranged in a ring and radially oriented, means which cooperate with the knives and which define, together with the latter, an annular space of limited width, and rotary means for continuously forming a layer of turns of tow, which turns are pressed into the above annular space, the turn in contact with the edges being cut by being pressed against the latter, and the fibers obtained escaping radially through the gap between the knives, a rotary annular fiber collector, coaxial with the ring of knives, the inlet of which is adjacent to the rear part of the knives, opposite the edges, and the outlet of which, staggered in the axial direction, is partially blocked by a fixed wall, said wall possessing at least one opening, coinciding with the outlet of the collector, each opening having associated therewith at least one moving garnett wire mounted for rotation through the plane of the opening in order to open the fibers.

The arrangement of the series of knives arranged in a ring, the means cooperating with the knives defining the annular space, the rotating means and pressing means for cutting the tow is generally known and it is possible to use an arrangement of the type according to French Pat. No. 1,552,881 and its Addition 2,030,230. According to this arrangement, the knives are arranged at the periphery of a rotating wheel, their cutting edge being directed outwards. The turns are wound around the knives, in the annular space between the knives and a pressure means which presses the tow against the cutting edges. This pressure means advantageously consists of a freely rotating pressure roller. The inside turn of the tow, which is wound over the edge of the knives without longitudinal sliding, is pushed onto the knives under the effect of the pressure of the roller, and it is cut into lengths of parallel fibers.

It is also possible to use an arrangement of the type according to French Pat. No. 2,242,491. According to this arrangement, the cutting edges of the knives are directed inwards and the tow is wound in the space between the ring of knives and a roller cage which is connected thereto, these two elements rotating relative to one another.

In accordance with the present invention, immediately after cutting, the fibers are presented in an ordered manner, oriented approximately along tangents to the ring of knives. The object of the new part of the device according to the invention is to collect the fibers, to lead them to the opening means, while preserving their arrangement, and to effect opening. Preferably, a cutting device of the type according to French Pat. No. 1,552,881 is used, in which the turns of tow are received in a space which is axially delimited by two side-plates arranged axially on each side of the knives; the said side-plates are held apart by spacers which can consist of the bodies of the knives themselves.

In the new part of the device, the annular collector extends radially inwardly from and communicates with the spaces or gaps between the cutting edges and has an outlet below the plane of the ring of the cutting edges. More particularly, the annular collector consists of two shaped coaxial surfaces of revolution. Advantageously, the two surfaces consist of two skirts made of a material having a low coefficient of friction relative to the fibers, such as polished metal or plastic; in axial section, the profile of the skirts is curved. The inlet of the collector is in the form of a cylindrical surface, the height of which (in the axial direction) corresponds to the height of the active part of the knives. The inlet is adjacent to the rear portion of the knives (opposite the edge). The inlet collects the cut fibers, while preserving their orientation; the fibers are carried along by the collector, forming a ring which rotates with the latter. In the case where the ring of knives rotates (for example French Pat. No. 1,552,881), the collector is integral in rotation with the wheel carrying the knives. The fibers advance into the collector along meridian lines, in the manner of a flow, under the effect of the upstream pressure in the annular space of limited width, in which the tow is being wound. In the case of the device according to French Pat. No. 1,552,881, this pressure is provided by the pressure roller.

The annular cross-section of the collector can be kept constant in the direction of advance of the ring fibers, hence defining the design of the skirts. However, by adapting the shape of the skirts, it is possible to vary the annular cross-section of the collector in the direction of advance of the ring of fibers, so as to create the desired pressure drop, for bringing the fibers out in the desired state, within the limit of the pressure prevailing in the annular space of limited width.

The outlet of the collector can be located either in a plane surface perpendicular to the axis of rotation of the latter, or in a frusto-conical surface, the top of which is located on the axis of the collector, or in a cylindrical surface, the axis of which coincides with the axis of the collector. The fixed wall which partially blocks the outlet of the collector advantageously consists of a plate adapted to the shape of the outlet, thus, it is either plane, or frusto-conical or cylindrical. the moving garnett wire can be carried by any frusto-conical cylindrical support or can be of the endless belt type. Preferably, it is carried by a rotary cylinder which will be designated by the term opening cylinder. In a known and usual manner, the garnett wire consists of at least one toothed ribbon wound in a spiral around the cylinder. The pitch of the spiral can have any value. The ribbon can be wound with a very small pitch, which is sufficiently small that it is possible to consider each turn of the toothed ribbon as being virtually contained in a plane perpendicular to the axis of the cylinder. The pitch of the spiral can be large and several spirals can be wound on the cylinder with the same pitch. By changing the pitch of the spiral, the angle of attack of the fibers by the teeth of the garnett wire can be modified to a certain extent. Depending on the characteristics of the tow treated, and on the results desired, different types of garnett wires can be used, namely rigid garnett wires with a more or less sharp profile of the teeth, or flexible garnett wires.

The arrangement of the opening cylinder, relative to the axis of the collector, depends, on the one hand, on the shape of the outlet of the collector, and on the other hand, for a given cylinder, on the desired angle between the direction of movement of the teeth and the orientation of the fibers when they are picked up by the cylinder.

In the case where the outlet of the collector is located in a plane perpendicular to the axis of the latter, and thus has the shape of a ring, the axis of the opening cylinder can be:

(a) radial, relative to the collector, and in a plane perpendicular to the axis of the latter;
(b) parallel to a tangent to one of the circles of the ring constituting the outlet orifice of the collector, or
(c) arranged in any intermediate position between the above two positions, depending on the desired angle between the movement of the teeth and the direction of the fibers.

In the case where the outlet of the collector is formed by a cylindrical surface coaxial with the collector, the axis of the opening cylinder can be:

(a) parallel to the axis of the collector;
(b) parallel to a tangent to the outlet orifice of the collector, and in a plane perpendicular to the axis of the collector, or
(c) arranged in any intermediate position between the above two positions, depending on the desired angle between the movement of the teeth and the direction of the fibers.

In the case where the outlet of the collector is formed along a frusto-conical surface, the axis of the opening cylinder can be:

(a) coincident with the axis of the collector and parallel to a generatrix of the cone;
(b) parallel to a tangent to the outlet orifice of the collector, and in a plane perpendicular to the axis of the collector, or
(c) arranged in any intermediate position.

For an opening cylinder which is provided with a garnett wire wound with a very small pitch, each turn being virtually contained in a plane perpendicular to the axis of the cylinder, then for the three types of collector outlet:

in the case of arrangement (a), the movement of the teeth is parallel to the direction of the fibers (parallel pick-up);
in the case of arrangement (b), the movement of the teeth is perpendicular to the direction of the fibers (perpendicular pick-up), or
in the case of arrangement (c), the movement of the teeth forms the desired angle with the direction of the fibers.

The opening cylinder can be driven in one or other of the directions of rotation. Thus, the garnett wire can pick up the fibers in the direction of their movement (integral with the movement of the collector) or in the opposite direction thereto. One or other of these arrangements is determined in accordance with parameters such as: the characteristics of the tow, the desired quality of the opening, the desired output and the like.

Optionally, means are provided for reversing the direction of rotation of the opening cylinder in order to be able to work in both directions with the same device. In this case, means are also provided for enabling the garnett wire to work in the correct direction.

According to the preferred embodiment, the opening cylinder is hollow, perforated on its lateral surface and open on its base surface. This arrangement causes a circulation of air, with axial suction and centrifugal discharge, which helps to pull the fibers away from the teeth. Advantageously, shaped radial blades are provided inside the cylinder, the purpose of these blades being to assist the circulation of air defined above. A peripheral and tangential channel for guiding the stream of fibers, ejected from the cylinder, up to a collecting means is associated with the opening cylinder. The opened fibers can then be brought to the usual device intended for collecting the flock for its subsequent use, for example, by suction. In order to increase the production capacity of the device, several opening cylinders can be arranged on the periphery of the outlet of the annular collector.

However, the invention will be more clearly understood with the aid of the examples and figures which are given below by way of illustration but without implying a limitation.

Figure 1:
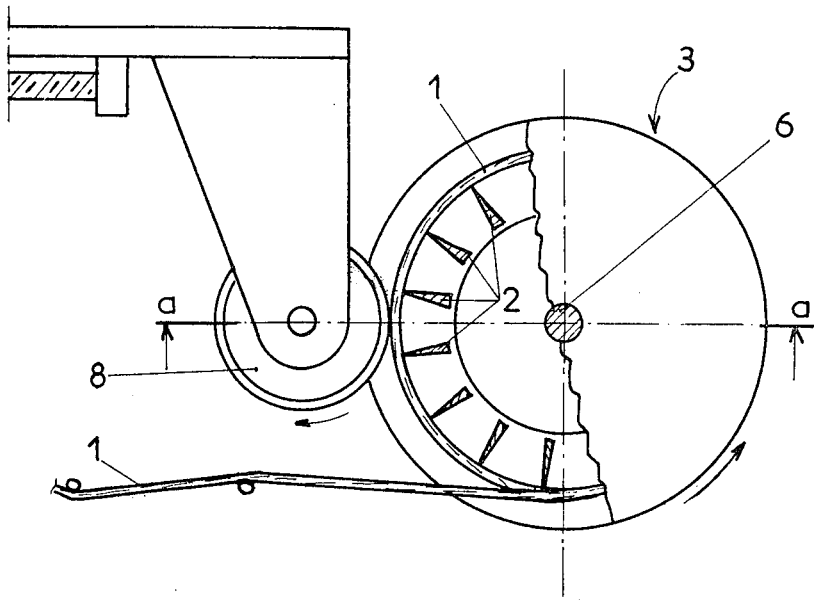
FIG.1 PRIOR ART
FIG. 1 shows a top view, in partial section, of a known device for cutting a tow, which is used to produce the device according to the invention.
Figure 2:
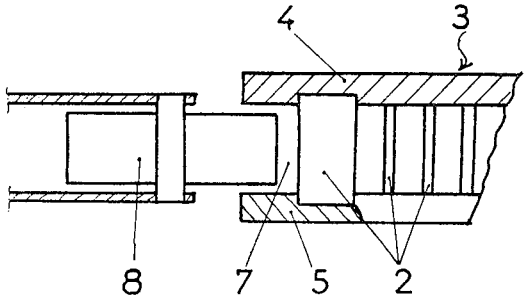
FIG. 2 PRIOR ART
FIG. 2 is a partial view of FIG. 1, in section, along a—a.

The cutting device of a known type, which is shown in FIGS. 1 and 2, comprises a series of knives 2, arranged in a ring in the manner of the bars in a squirrel cage, their edge facing outwards. The knives are mounted on wheel 3, comprising two side-plates 4 and 5, and are caused to rotate about axis 6. In the axial direction, two side-plates 4 and 5 bound circular groove 7, in which turns of tow 1 are wound, the tow being fed in tangentially to the wheel for at least one revolution over the ring defined by the edges of the series of knives. Groove 7 constitutes an annular space which is radially bounded by freely rotating pressure roller 8, which exerts a preset pressure. Tow 1 is pressed by roller 8 against knives 2. This pressure ensures the cutting of the tow into an ordered array of fibers of fixed length (defined by the distance between consecutive cutting edges) and drives fibers 9, thus obtained, downstream of the knife blades, that is to say, towards the center of wheel 3.

Figure 3:
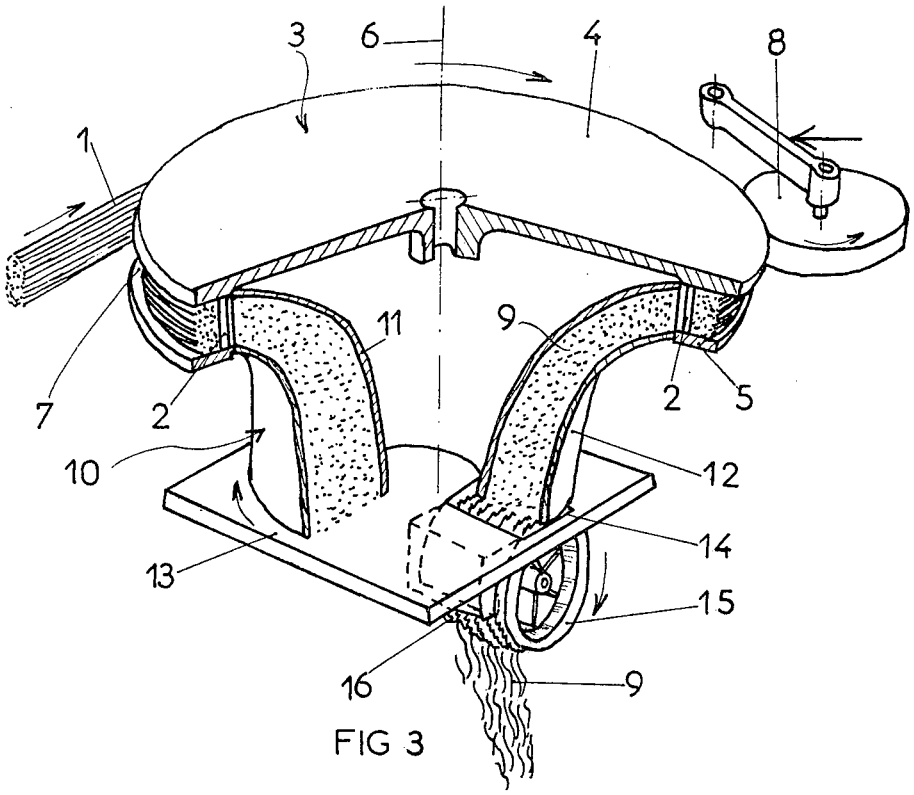
FIG. 3 is an exploded schematic view of an embodiment of the device according to the invention.

The known part shown in FIGS. 1 and 2, namely rotary wheel 3 with knives 2 and pressure roller 8, is also used in the embodiment, of the device according to the invention, shown in FIG. 3.

According to the invention, a rotatable annular fiber collector 10 is provided, which is coaxial with wheel 3 and integral in rotation therewith. It consists of two shaped skirts 11 and 12, made of polished metal. In section along the axis, the skirts have a curved profile with a concavity facing outwards. The inlet orifice of the collector is in the form of a cylindrical surface adjacent to the rear part of the knives. The outlet orifice of the collector is located in a plane perpendicular to the axis of the latter. It is partially blocked by fixed plate 13. As the ring of fibers behaves essentially like a flow, the spacing between skirts 11 and 12 increases in the direction of advance of the fibers, so that the cross-section corresponds to the desired pressure drop at all points. In opening 14 in plate 13, rotary opening cylinder 15 is inserted. The lateral surface of cylinder 15 is approximately tangential to the fibers moving over plate 13. The axis of cylinder 15 is radial and lies in a plane perpendicular to the axis of the collector. On its periphery, cylinder 15 comprises garnett wire 16 for opening the fibers. The cylinder is caused to rotate by a self-contained means, such as an electric motor, or alternatively by the motor for driving wheel 3.

Figure 5:
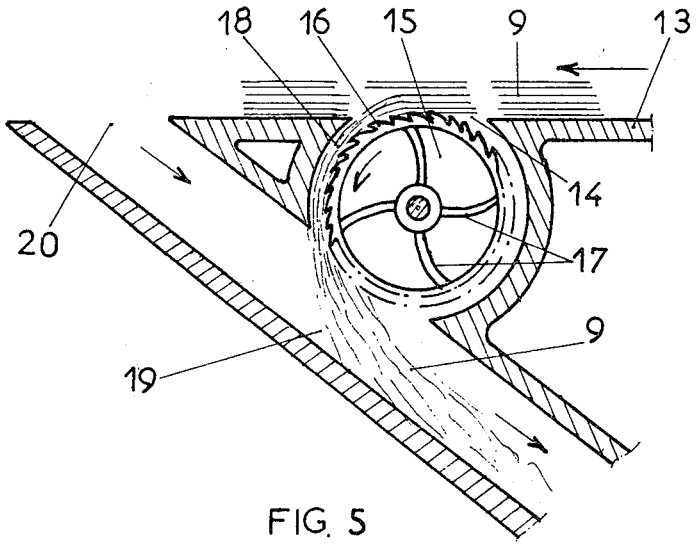
FIG. 5 is a detailed view of a portion of the device according to FIG. 3.

Cylinder 15, which is also shown in FIG. 5, is hollow and its side wall (carrying the garnett wire) is perforated. The hub of the cylinder and its side wall are joined by shaped radial ribs or blades 17, which also serve to assist a circulation of air, with suction through the side of the cylinder and discharge through the perforations in its lateral surface. The purpose of this circulation is to assist the pulling of the fibers away from the teeth of garnett wire 16. In this example, the garnett wire consists of a toothed ribbon which is wound in a spiral on cylinder 15 with a very small pitch, the tangent to the spiral lying in a plane which is virtually perpendicular to the axis of the cylinder.

According to a simple modified embodiment, opening cylinder 15 can consist of a hub, a sufficient number of radial blades, and a toothed ribbon which is wound directly around the edges of the blades and constitutes the garnett wire.

Peripheral channel 18, originating at the orifice 14 and emerging in a tangential passage 19, is associated with cylinder 15. The purpose of channel 18 and passage 19 is to guide the stream of fibers, discharged by cylinder 15, up to a device, which is not shown, for collecting the opened fibers. Channel 19 is advantageously open to the air at 20, upstream of the cylinder, so as to create a suction and then a circulation of air, assisting the discharging of the fibers into the channel.

In a modified embodiment for increasing the production capacity of the device, several orifices 14, and a corresponding number of opening cylinders 15, similarly arranged around the axis of the collector, are provided.

OPERATION (FIGS. 3, 4 AND 5)

The fibers cut against the edges of knives 2, under the effect of the pressure exerted by roller 8, form a ring which advances longitudinally into fiber collector 10. Considered in a plane, for example, the plane of plate 13 (FIG. 4), the fibers form a ring 21 consisting of lengths 22, the fibers in each length 22 being parallel to one another to within the radius of curvature. The fibers reaching orifice 14 in plate 13 are seized by the teeth of cylinder 15, carried into channel 18, separated, and then ejected, by the centrifugal effect, from cylinder 15 into channel 19, in the form of a stream of opened fibers, and led through channel 19 to a collecting device. In view of the very small winding pitch of garnett wire 16 on cylinder 15, and of the radial arrangement of the axis of the cylinder, the teeth of the garnett wire are arranged along spirals, the tangent of which forms an angle of about 90° with the radii of the ring described by fibers 9 on plate 13. The fibers are thus presented in a direction which is approximately parallel to the movement of the teeth; parallel pick-up is achieved.

As has been mentioned in the general description, by arranging the axis of cylinder 15 along a line parallel to a tangent to the ring of fibers, perpendicular pick-up would be achieved.

By arranging the axis of cylinder 15 in an intermediate position between the above two positions, it is possible to achieve pick-up at any desired angle.

Figure 4:
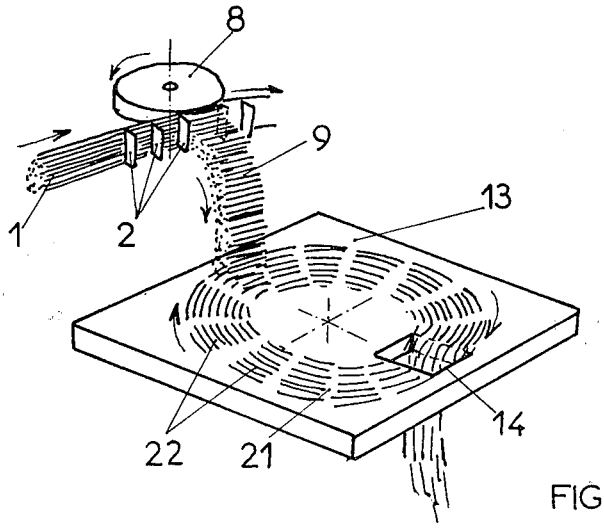
FIG. 4 is a schematic view illustrating the operation of the device according to the invention.
Figure 6:
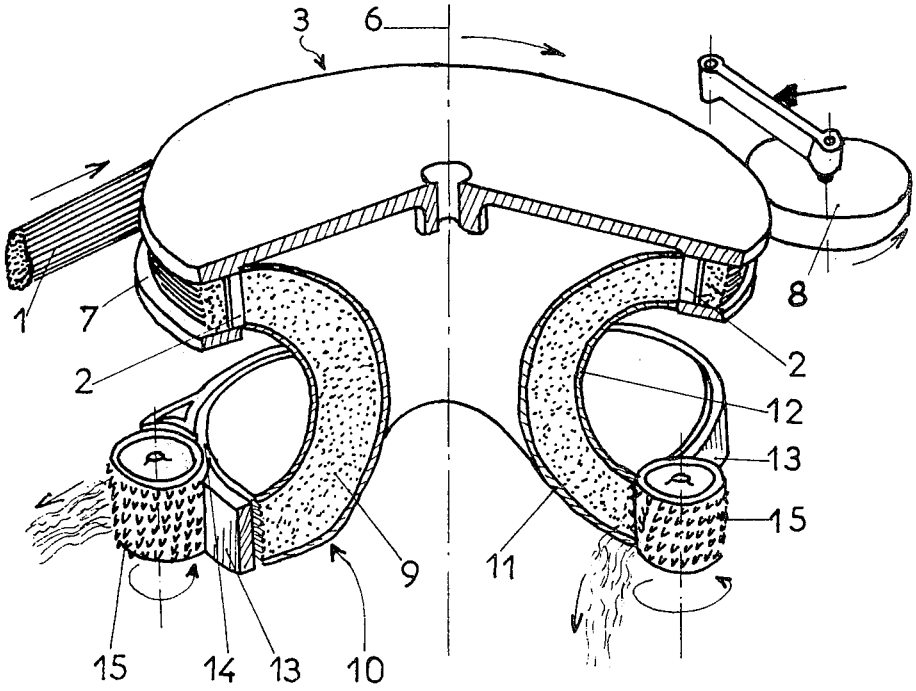
FIG. 6 is an exploded schematic view of another embodiment of the device according to the invention.

The embodiment shown in FIG. 6 differs from that in FIG. 4 by the fact that the outlet orifice of collector 10 has the shape of a cylindrical surface which is partially blocked by plate 13, also of cylindrical shape. Two opening cylinders, with axes parallel to the axis of the device, are provided. In this case also, it is possible to vary the orientation of the axis of the cylinders in order to pick up the fibers at the desired angle.

By way of example, using a device according to FIG. 3, a 100 ktex polyester tow having a gauge per strand of 1.7 dtex is treated. The tow is fed in at a rate of 200 m/minute and the cutting length is 40 mm. This gives an output of opened flock of 1,200 kg/hour. By increasing the number of opening cylinders 15 and the feed rate, it is possible easily to increase the output of the device, for example up to 1,500 to 2,000 kg/hour and above.

The process of the apparatus according to the invention have numerous applications and advantages, namely:

(a) the opening of fibers at the production site;

(b) the direct manufacture of wadding or opened napping fibers;

(c) the preparation of fiber blends by simultaneously feeding in two or more tows; a perfectly homogeneous blend is obtained;

(d) at the spinning mill, the production of opened flock directly from tow; the customer equipped with apparatus according to the invention will receive tow instead of bales of flock;

(e) it will also be possible to shorten the process for the production of spun yarns, by omitting operations such as the preparatory opening of the bales; in view of the output of a card, which is essentially 50 kg/hour, a single device will be sufficient to feed about thirty cards, and (f) the direct feeding of spinning devices of the type for spinning open-end fibers.

These examples of application do not imply any limitation.

Of course, the invention is not restricted to the illustrative embodiments described; on the contrary, it can posses all the variants which fall within the scope of the general description and appended claims.

The invention applies to tows of continuous filaments made of any artificial or synthetic materials.

What is claimed is:

1. A process for cutting a tow of continuous filaments and continuously opening the fibers obtained comprising, continuously winding the tow in at least one revolution over the edges of a plurality of cutting edges arranged in a ring, pressing the tow against the cutting edges to cut the filaments of the tow into ordered arrays of fibers of fixed length defined by the distance between consecutive cutting edges, collecting the ordered arrays of fibers immediately downstream of the cutting edges, and feeding the collected fibers in an orderly arrangement to an opening means whereby the fibers of the orderly arrangement are continuously opened.

2. The process according to claim 1 wherein the orderly arrangement of fibers is opened by at least one garnett wire.

3. The process according to claim 2 wherein the collected fibers are fed to the garnett wire in a direction which is at least substantially parallel to the relative movement of the teeth of the garnett wire.

4. The process according to claim 2 wherein the collected fibers are fed to the garnett wire at an angle up to about 90° relative to the movement of the teeth of the garnett wire.

5. An apparatus for cutting a tow of continuous filaments and continuously opening the fibers obtained, said apparatus comprising:

(a) a series of cutting edges arranged in a ring and radially oriented;

(b) means associates with the series of cutting edges and defining therewith an annular space extending radially from the cutting edges;

(c) means for winding said tow in at least one turn in said annular space;

(d) means for pressing the tow wound in said annular space against said cutting edges to cut said tow into an orderly array of fibers and propel said fiber array radially through the spaces between the cutting edges;

(e) a rotatable annular fiber collector extending radially from and communicating with the spaces between the cutting edges and having an outlet below the plane of the ring of the cutting edges;

(f) a fixed wall partially blocking the outlet of the fiber collector, said wall having at least one opening coinciding with said outlet, and (g) at least one garnett wire associated with each opening and mounted for rotation through the plane of the opening, whereby fiber bundles passing through the fiber collector, and rotating therewith land on the fixed wall and come to the opening or openings in the plate where they are opened by the rotating garnett wire.

6. The apparatus according to claim 5, wherein the fiber collector comprises two skirts in the form of shaped coaxial surfaces of revolution.

7. The apparatus according to claim 5 or 6, wherein the outlet of the fiber collector lies in a plane perpendicular to the axis of the fiber collector.

8. The apparatus according to claim 5 or 6, wherein outlet of the fiber collector lies in a frusto-conical surface, the top of the cone being located on the axis of the fiber collector.

9. The apparatus according to claim 5 or 6, wherein the outlet of the fiber collector lies in a cylindrical surface which is coaxial with the collector.

10. The apparatus according to claim 5 or 6 wherein each garnett wire is arranged at the periphery of at least one rotatable cylinder.

11. The apparatus according to claim 10, wherein the cylinder carrying the garnett wire is arranged so that the fibers are presented to the garnett wire in a direction which is approximately parallel to the movement of the teeth of the wire.

12. The apparatus according to claim 10, wherein the cylinder carrying the garnett wire is arranged so that the fibers are presented to the garnett wire in a direction which is at least substantially perpendicular to the movement of the teeth of the wire.

13. The apparatus according to claim 10, wherein the cylinder carrying the garnett wire is arranged so that the fibers are presented to the garnett wire at an angle of more than 0° and less than 90°, relative to the movement of the teeth of the wire.

14. The apparatus according to claim 10 which comprises at least two openings in said fixed plate, each opening having associated therewith a cylinder provided with a garnett wire, said cylinders being located at the periphery of the outlet of the annular collector and extending at least through the plane of each of said opening.

15. The apparatus according to claim 5 or 6, wherein the cutting edges are arranged at the periphery of a rotatable wheel, and wherein the fiber collector is integral in rotation with said rotatable wheel.

16. The apparatus of claim 5 wherein the cutting edges are arranged in a ring and radially oriented with the edges facing outward; said annular space extending radially outwardly from the cutting edges; said pressing means propelling said fiber array radially inwardly through the spaces between the cutting edges; and said rotatable annular fiber collector extending radially inwardly from and communicating with the spaces between the cutting edges.

* * * * *